US005143523A

United States Patent [19]

Matarrese

[11] Patent Number: 5,143,523

[45] Date of Patent: Sep. 1, 1992

[54] DUAL-COATED DIAMOND PELLETS AND SAW BLADE SEMGENTS MADE THEREWITH

[75] Inventor: Roger R. Matarrese, Upper Arlington, Ohio

[73] Assignee: General Electric Company, Worthington, Ohio

[21] Appl. No.: 762,999

[22] Filed: Sep. 20, 1991

[51] Int. Cl.[5] ..... B24D 3/00

[52] U.S. Cl. ..... 51/293; 51/295; 51/309

[58] Field of Search ..... 51/293, 295, 309

[56] References Cited

U.S. PATENT DOCUMENTS

| | | | |
|---|---|---|---|
| 4,212,137 | 7/1980 | Rue | 51/298 |
| 4,246,004 | 1/1981 | Busch et al. | 51/309 |
| 4,770,907 | 9/1988 | Kimura | 427/217 |
| 4,776,861 | 10/1988 | Frushour | 51/293 |
| 4,883,500 | 11/1989 | Deakins et al. | 51/295 |

*Primary Examiner*—Mark L. Bell
*Assistant Examiner*—Willie J. Thompson
*Attorney, Agent, or Firm*—Gary L. Loser

[57] ABSTRACT

One aspect of the present invention is a method for making metal-clad particle pellets which comprises the steps of:

(a) coating diamond particles with a carbide-forming metal;

(b) spraying onto a bed of gas-fluidized coated abrasive particles of step (a) a slurry of metallic powder, a binding agent, and a volatile solvent, for a time until each abrasive particle is outer coated with at least about 20 wt-% of said metallic powder, said metallic powder having a sintering temperature that is at least about 50° C. lower than the melting point temperature of said carbide-forming metal;

(c) recovering said metal powder-coated abrasive pellets of step (b) substantially devoid of said volatile solvent;

(d) heating said recovered coated abrasive pellets under conditions to form a sintered continuous outer metal coating on said abrasive pellets; and (e) heating said pellets of step (d) at a second higher temperature to liquefy said carbide-forming metal for forming some metal carbide from said diamond particle. The resulting dual metal-clad abrasive pellets form yet another aspect of the present invention.

Another aspect comprises:

(a) placing a plurality of abrasive pellets, each comprising an abrasive particle coated with at least about 20 wt-% sintered metal, metal pellets devoid of abrasive particles, and a source of braze metal in a mold cavity; and (b) heating the contents of said mold cavity under conditions of temperature, pressure, and atmosphere to form an abrasive particle-containing metal saw blade segment of desired abrasive particle concentration.

15 Claims, 3 Drawing Sheets

DUAL-COATED DIAMOND PELLETS AND SAW BLADE SEMGENTS MADE THEREWITH

CROSS-REFERENCE TO RELATED APPLICATIONS

This application is cross-referenced to co-pending application Ser. No. 07/763,089 filed on even date herewith, the disclosure of which is expressly incorporated herein by reference.

BACKGROUND OF THE INVENTION

The present invention relates to saw blades of the kind used for sawing hard and/or abrasive materials such as, for example, granite, marble, concrete, asphalt, and the like; and more particularly to metal-clad abrasive particle pellets useful in forming saw blade cutting segments.

Conventionally, the cutting of hard materials such as, for example, granite, marble, filled concrete, asphalt, and the like, has been achieved using diamond saws. The blade of saws of this type comprises a circular steel disk having a plurality of spaced segments about its cutting edge, which segments consist essentially of diamond abrasive bonded in a suitable alloy or metal matrix, such as bronze or cobalt, for example. The diamond abrasive typically is either a single crystal natural diamond or a single crystal synthetic diamond. U.S. Pat. No. 4,883,500 proposes the use of a combination of thermally stable polycrystalline diamond cutting elements and single crystal diamond cutting elements dispersed in a bonding matrix.

A variety of problems have plagued the artisan in fabricating segments and saw blades containing such segments. For example, to optimize diamond saw blade performance, it would be desirable to prevent agglomeration of diamond in the metal bond powders during mixing and blending. This would permit maximum utilization of the diamond abrasive crystals. Further, it would be convenient to have controlled porosity within each segment to provide localized coolant during use, to minimize thermal degradation of diamond, and/or the bond metal.

In granite sawing with rotary saw blades, for example, lateral deflection of the blade as it enters harder areas of the stone can give rise to non-flat portions of the surface being cut. This leads to the need for expensive grinding and reduces the profit for the stone processor. One solution to this problem in the field has been to make sandwich segments with differential wear patterns to provide a matching track on the stone which reduces the chances of lateral blade deflection during the cut. Until now, the differential wear has been achieved by either varying concentration of the diamond across the face, or by adding wear resistant material in the outer portions of the segments, such as proposed in U.S. Pat. No. 4,883,500, cited above. These methods use the technique for filling the pressing cavity in three consecutive cold pressing steps, and then hot pressing to sinter the metal matrix powder in a separate operation.

It has been common practice for several decades to blend or mix diamond abrasive powders with fine metal powders to form segments by hot pressing in a sintering press. Air-borne fine metal powders, if toxic or carcinogenic, represent a potential health hazard. In addition, differences in size, shape, and density between diamond and metals make production of homogeneous mixtures difficult. Also, it would be convenient to be able to automate mold loading.

BROAD STATEMENT OF THE INVENTION

The present invention addresses the foregoing problems and many more in the diamond saw blade and segment art. One aspect of the present invention is a method for making metal-clad particle pellets, which comprises the steps of:

(a) coating diamond particles with a carbide-forming metal;

(b) spraying onto a bed of gas-fluidized coated abrasive particles of step (a) a slurry of metallic powder, a binding agent, and a volatile solvent, for a time until each abrasive particle is outer coated with at least about 20 wt-% of said metallic powder, said metallic powder having a sintering temperature that is at least about 50° C. lower than the melting point temperature of said carbide-forming metal;

(c) recovering said metal powder-coated abrasive pellets of step (b) substantially devoid of said volatile solvent;

(d) heating said recovered coated abrasive pellets under conditions to form a sintered continuous outer metal coating on said abrasive pellets; and (e) heating said pellets of step (d) at a second higher temperature to liquefy said carbide-forming metal for forming some metal carbide from said diamond particle. The resulting dual metal-clad abrasive pellets form yet another aspect of the present invention.

Another aspect comprises:

(a) placing a plurality of abrasive pellets, each comprising an abrasive particle coated with at least about 20 wt-% sintered metal, metal pellets devoid of abrasive particles, and a source of braze metal in a mold cavity; and (b) heating the contents of said mold cavity under conditions of temperature, pressure, and atmosphere to form an abrasive particle-containing metal saw blade segment of desired abrasive particle concentration.

Advantages of the present invention include the production of dual metal-clad pellets that have an inner metal carbide coating and an outer metal coating for maximizing compatability of the pellets in metal bond tools and tool segments for resisting pull-out. Another advantage is a saw blade segment production technique that permits the fabricator to control abrasive particle density and distribution in the saw blade segment. These and further advantages of the present invention will be readily apparent to those skilled in the art based upon the disclosure contained herein.

Figure 1:
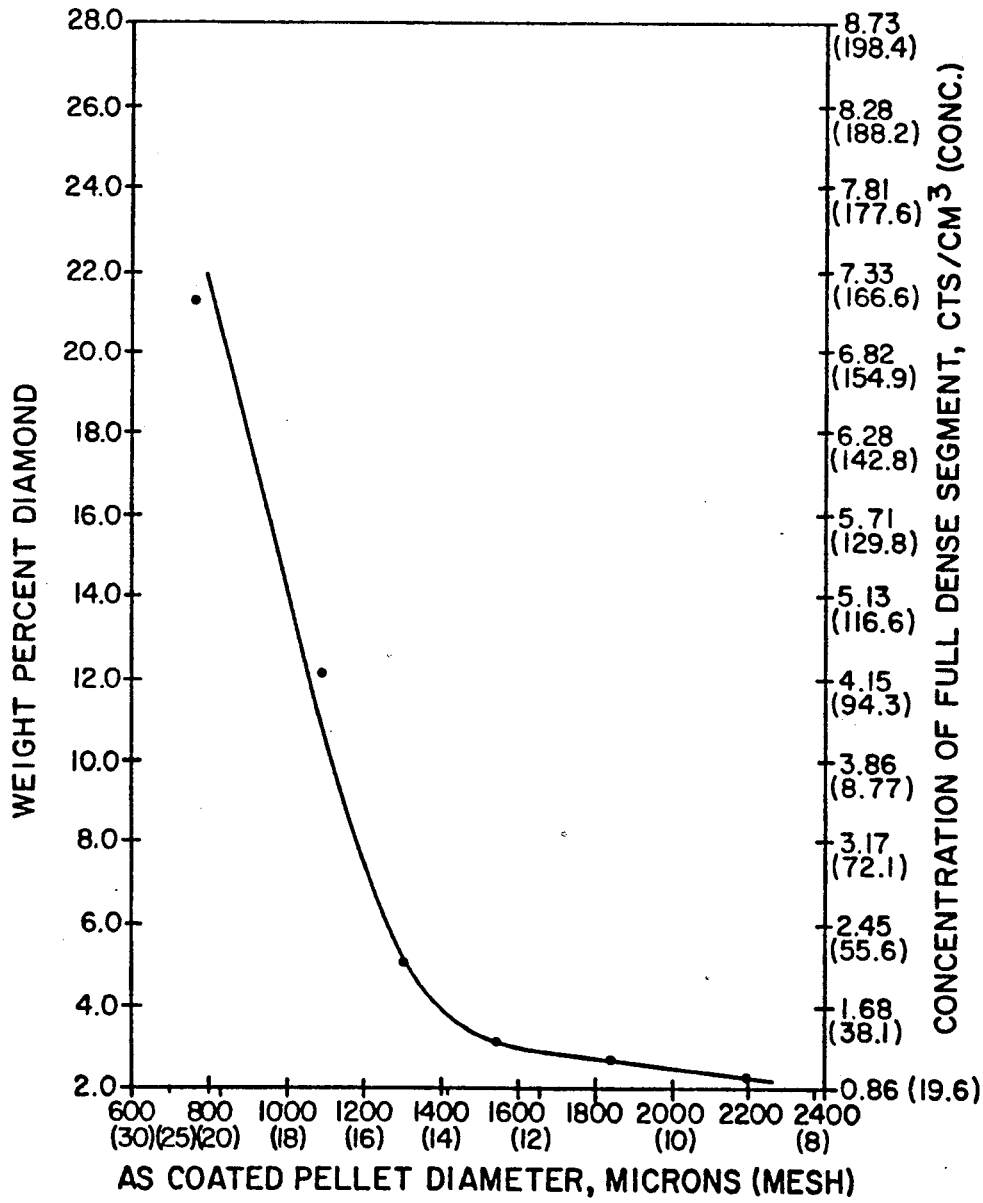
FIG. 1 displays the diamond content of the pellets by plotting the diamond content in weight-percent and concentration in carats/cm$^3$ for 30/40 mesh diamond pellets coated with cobalt verus the pellet diameter.

The drawings will be described further below.

DETAILED DESCRIPTION OF THE INVENTION

The preferred method for coating abrasive particles (e.g. diamond particles and cubic boron nitride, CBN, particles) is described in U.S. Pat. No. 4,770,907, the disclosure of which is expressly incorporated herein by reference. Such coating method comprises the steps of preparing a slurry of metallic powder and a binding agent dissolved in an organic solvent, fluidizing a quantity of abrasive grains in a work vessel, and spraying the slurry into the vessel onto the abrasive grains during the fluidizing thereof for building and drawing a generally uniform coating of the slurry on each of the abrasive grains. For practice of the present invention, however, use of aqueous binders is feasible and sometimes even preferred for certain metal powders. The '907 patent proposes the use of such as-coated abrasive particles in the formation of saw blade segments. During the course of research leading to the present invention, it was determined that using such green (unsintered) abrasive particle pellets resulted in breakdown of the pellets and non-uniform distribution of abrasive particles. While such green pellets were an improvement over handling the metal powder and abrasive particles separately for incorporation into a mold, such green pellets were determined to be too fragile for handling as an article of commerce. Thus, while the basic coating process and machinery disclosed in the '907 patent are preferred for practice of the present invention, variation from such process as described herein is advantageous for maximizing the advantages of the present invention.

Accordingly, one aspect of the present invention is directed to a method for making abrasive particle pellets with a tenaciously-clad dual metal coating. The initial steps of this process are conducted in accordance with U.S. Pat. No. 4,770,907, cited above, except that the binding agent can be dissolved in an aqueous solvent or an organic solvent. In this regard, the binding agent conveniently may be thermoplastic in order that the binder set or become "cured" merely by the evaporation of the solvent which occurs concurrently during the pellet formation in the gas-fluidized bed of abrasive particles. Alternatively, thermosetting binders can be used if they cure at the fluidizing gas temperatures used. Fluidizing gas temperatures will not be too excessive lest special equipment and handling procedures be required. Thus, the binders of choice should be curable at relatively low temperatures, e.g. not substantially above about 100° C.

The fluidizing gas conveniently comprises air for efficiency and economy, though inert or other gases may be used as is necessary, desirable, or convenient. For example, non-oxidizing gases may be preferred should the metallic powder be sensitive to oxidation. As is taught in the '907 patent, the weight percent of coating adhering to the abrasive particles is a function of the time that the fluidized bed of particles is subjected to the slurry spraying operation. For present purposes, the proportion of metallic carbide-forming powder should be at least about 20 wt-% of the abrasive particles which are enveloped thereby. Such minimum metallic carbide-forming powder coating level ensures that each abrasive particle is coated or enveloped by the metallic carbide-forming powder. In this regard, it will be appreciated that for certain purposes, an incomplete inner coating of the abrasive particles may be acceptable, though preferably each abrasive particle is entirely enveloped by a continuous metallic coating.

The green abrasive particle pellets removed from the initial spraying operation will be substantially devoid of volatile solvent by virtue of the fluidizing gas drying thereof and will be essentially spherical in shape. Heating of the green pellets can be practiced for removing additional solvent if required.

The inner coat is formed from a carbide-forming metal which preferably is selected from nickel, cobalt, iron, chromium, titanium, tantalum, tungsten, molybdenum, boron, vanadium, silicon, zirconium, hafnium, niobium, and the like, and mixtures thereof. While such inner coating could be sintered, preferably such coated abrasive particles then are coated with a slurry of metallic powder, binding agent, and volatile solvent, for a time until each coated abrasive particle is outer or overcoated with at least about 20 wt-% of said second metal powder. Such second metallic powder has a sintering temperature that is at least about 50° C. lower than the melting point temperature of the carbide-forming metal. The dual-coated abrasive pellets then are heated under conditions to form a sintered continuous outer metal coating on the abrasive pellets. Thereafter, the temperature is raised to a second, higher temperature to liquefy the carbide-forming metal for forming some metal carbide from the diamond particle. By forming some metallic carbide from the inner carbide-forming metal coating and diamond abrasive particle, the integrity of the coating and its adherence to the diamond particles will be substantially increased.

The outer sintered coating insures that the inner carbide-forming metal can be liquefied and not lost during its liquid phase transition. The integrity of the spherical-nature of the pellets is retained additionally. The temperature differential of at least about 50° C. insures that the outer metal coating will sinter before the inner coating liquefies. Desirably, this temperature differential is at least about 100° C. Additional outer coatings, which may be continuous or discontinuous, comprise the use of braze metals or alloys, flux coatings, and the like for enhancing use of the novel pellets in metal saw blade segments, and other tools and tool segments. When such coated particles then are used in the formation of saw blade segments, the metal coatings can be bonded with the segment metal matrix which, combined with the metallic carbide coating, will minimize premature pull-out of the abrasive particles during sawing operations.

The sintering temperatures and conditions necessarily depend on the particular metallic powders chosen for dual-coating the abrasive particles. Conditions may include vacuum, and inert or reducing atmospheres being maintained during the sintering operation. The binding agent typically is removed during the sintering operation. Thus, some heating of the particles coated only with the carbide-forming metal inner coating to burn off the binder may be advisable prior to overcoating such coated particles. In this regard, it will be appreciated that the size of the green pellets removed from the fluidizing operation necessarily depend upon the spraying time.

Sintering of the green particles to form the sintered abrasive particle pellets of the present invention results in a reduction in pellet size due to the fusing of the powdered metals into a continuous metal coatings. The degree of porosity, if any, in the metal coatings also is determined by the metal powders particle size, sintering conditions, and the amount of metal carbide formed from the inner coating and the diamond abrasive particle. Such sintering conditions desirably are preclusive of melting of the outer metallic powder which would result in the loss of particle discreteness. The sintered pellets also will be essentially spherical if care is exercised during the sintered step of the process. Typical particle sizes will range from about 0.2 to 2.4 mm. In this regard, a flux or braze overcoat may be employed for facilitating formation of saw blade segments from such abrasive particle pellets.

The metals used in overcoating the inner-coated diamond particle can be selected from a wide variety of metals already used in the abrasive art. Such metals include, for example, cobalt, nickel, iron, copper, tin, molybdenum, boron, titanium, tungsten, chromium, vanadium, manganese, niobium, zirconium, hafnium, and the like, and alloys, carbides, and mixtures thereof.

In the making of metal saw blade segments, another aspect of the present invention recognizes the need for controlling the abrasive particle concentration in the saw blade segment. Abrasive particle concentration can be controlled through variation of abrasive pellet size distribution or by the use of metal pellets, of the same or different size, which are devoid of abrasive particles, or by a combination of these techniques. Diamond pellets can be the novel dual-coated pellets of the present invention or the sintered pellets of application U.S. Ser. No. 763,089 cited above. The remaining steps for formation of such metal saw blade segment are practiced in conventional fashion as those skilled in the art are well aware.

Figure 2:
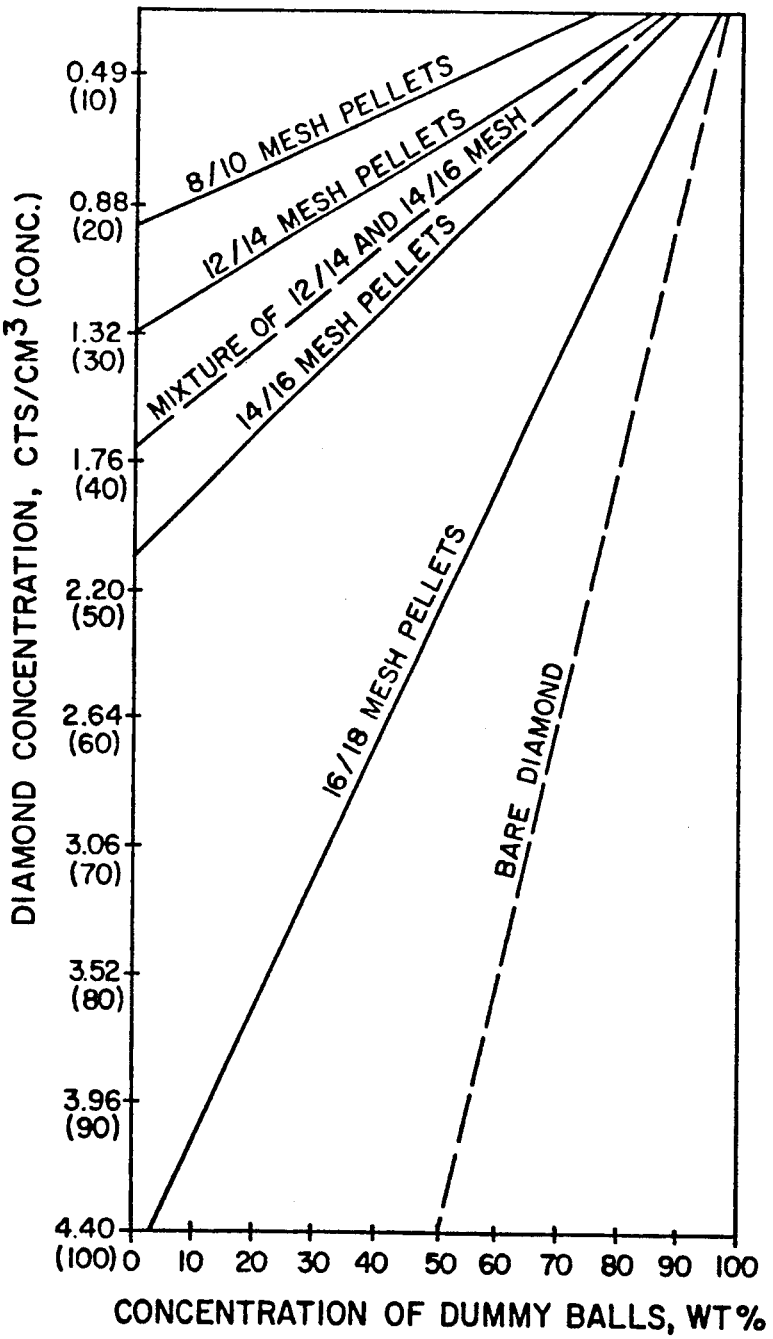
FIG. 2 displays the effect of mixing dummy balls with the diamond pellets by plotting the concentration of dummy balls versus the diamond concentration for various mesh sizes of diamond pellets.

In practicing such a metal saw blade segment fabrication process, the diamond content for the pellet sizes of interest can be determined by standard assay procedure (e.g. dissolution of metal in acid). Based on the assay results, calculations of ultimate diamond content in the saw blade segment can be made, assuming full densification. The resultant data can be plotted showing the relationship between diamond content and size of the pellets for any given diamond size. Diamond content can be displayed as weight percent as well as carats per unit volume of the segment as shown in the FIG. 1. This example is for 30/40 mesh diamond coated with cobalt. The effect of mixing dummy pellets or balls (sans diamond) with monosized abrasive pellets additionally can be plotted as shown in FIG. 2. The mesh size necessary to achieve any diamond concentration can be determined from such a graph. When mixing monosized pellets with dummy balls, the graph also can be used to determine relative proportions needed for a given concentration. When mixing pellets of different mesh size, the simple rule of mixtures can be used to calculate the proportion of each size needed to achieve a given concentration, or assays of samples of the mixture also can be performed to determine actual diamond content. The resultant value of diamond concentration then can be located on one axis of the graph at zero concentration of dummy balls. By drawing a straight line from this point to the point representing 100% dummy ball concentration and zero percent diamond concentration, the subject mixture can be represented (e.g., the mixture of 12/14 and 14/16 mesh pellets shown in FIG. 2). From this line, any diamond concentration within the limits of the plotted line can be achieved by mixing with an appropriate amount of dummy balls, as indicated on the appropriate axis of the graph.

Additional unique saw blade segments also are disclosed in application U.S. Ser. No. 763,089 and advantageously may be formed using the novel pellets of the present invention. The following description of such novel segments is set forth below. In connection with the formation of metal saw blade segments utilizing either of the novel sintered dual-coated abrasive particle pellets disclosed herein, it would be advantageous if the porosity of the saw blade segment were controlled to enable cooling fluid to penetrate into the segment and to aid in chip removal, e.g. from about 10% to 50% of full density. Utilizing the relatively large sintered pellets of the present invention enable packing configurations in saw blade segment molds to be designed and maintained. By then controlling the pressure and temperature of formation of the saw blade segment, a designed degree of porosity can be achieved. In this regard, maintaining too high of a pressure results in a full dense saw blade segment, while insufficient pressure results in insufficient integrity of the saw blade segment for achieving expected commercial life expectancies of saw blade segments. An outer braze coating can envelope the pellets or a source of braze metals or braze metal alloy can be placed adjacent the packed mold for contributing to the formation of the saw blade segment. Additional matrix metal powder additionally can be used in forming the metal saw blade segments.

Regardless of the technique employed, an open cell structure, i.e. interconnected porosity is achieved, particularly using the sintered metal-clad abrasive particle pellets of the present invention. It will be appreciated that the size distribution of the pellets can be monodispersed in nature or can be polydispersed depending upon the ultimate porosity requirements of the saw blade segment, which can be controlled across the width of the saw blade segment in order to aid in variable cutting efficiency, such as is taught to be desirable in U.S. Pat. No. 4,883,500, cited above.

Figure 3:
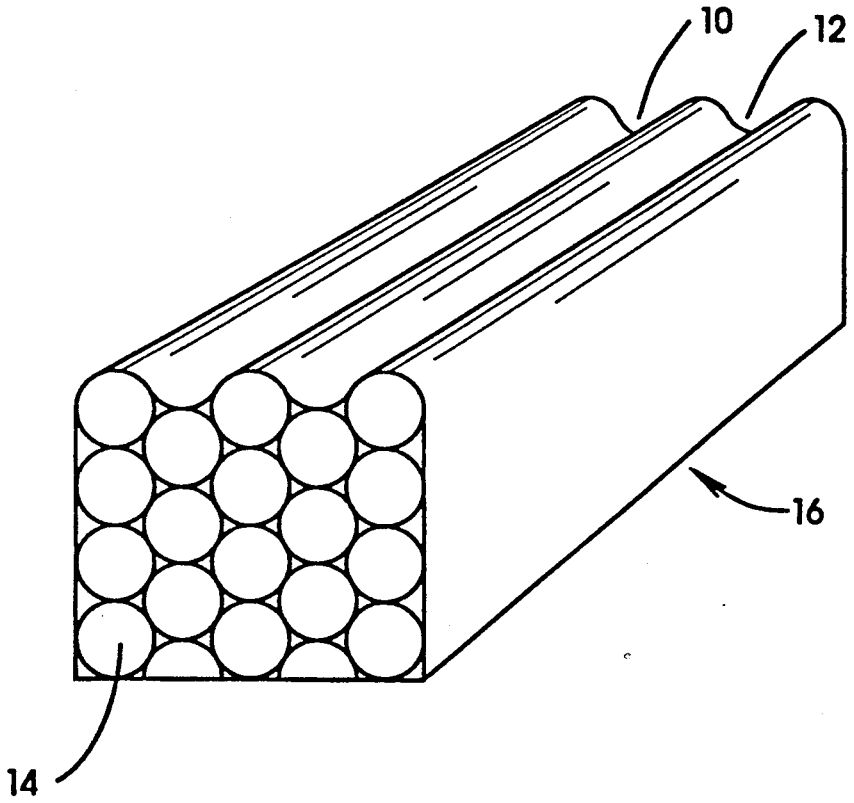
FIG. 3 is a perspective view of a saw blade segment made with an array of the novel sintered pellets showing the furrow pattern that develops on its cutting edge with sawing a substrate with a saw blade containing such segment.

As described in U.S. Pat. No. 4,883,500, differential wear is important in fabricating saw blades that are resistant to lateral deflection during the sawing of, for example, granite. Varying the concentration of the diamond across the face or adding wear resistant material in the outer portions of the segments have been proposed in the art for achieving such effect, such as shown at FIG. 2 of the '500 patent. Unexpectedly, development work on the copending application revealed the fact that saw blade segments made with its sintered pellets could achieve such a cutting pattern. It is expected that the novel dual-coated pellets of the present invention will perform similarly. While such cutting pattern can be attributed to providing a higher diamond or other abrasive particle concentration at the periphery of the saw blade segments (e.g. using the dummy balls and a higher proportion in the center of the saw blade segment), full dense segments have shown this "tracking" effect without special abrasive particle gradients being established. Long, parallel furrows are developed as a result of the ordered rows of diamonds in the segment. Ordering is a result of close packing of spherical pellets in the mold. The wear pattern develops as shown in FIG. 3. Such a differential wear pattern results in a matching and interlocking surface in the stone being cut which aids in suppressing lateral deflection of the blade during sawing operations. Depending upon the width of the saw blade and the size of the abrasive particle pellets, an array of a multitude of rows parallel with the lengthwise extent of the segment, and hence the cutting edge of the saw blade, can be achieved readily with resultant tracking achieved thereby. It will be appreciated that such segments may contain porosity or be full dense.

Depending upon the width of the saw blade and the size of the abrasive particle pellets, an array of a multitude of rows parallel with the lengthwise extent of the segment, and hence the cutting edge of the saw blade, can be achieved readily with resultant tracking achieved thereby. It will be appreciated that such segments may be fabricated from either of the novel pellets disclosed herein and may contain porosity or be full dense. Moreover, the use of dummy balls will aid in the fabrication of abrasive particle gradients in saw blade segments.

Segments manufactured in accordance with the novel sintered pellets present invention are adaptable for use in deep sawing applications, slabbing operations, cut-off operations, frame sawing, multi-blade sawing, wire sawing, belt saws, thin wall core drilling, and various contour and shaping operations. Materials which can be cut with segments of the present invention include concrete, filled concrete, reinforced conceret, asphalt, marble, granite, limestone, sandstone, wood, metals, plastics, composites, and the like.

A wide variety of saw blade segment designs are known in the art and are useful, such as, for example, disclosed in U.S. Pat. No. 4,883,500. Other variations, modifications, and rearrangements may be made to the present invention without departing from the spirit or intended scope of the present invention.

We claim:

1. A method for making metal-clad diamond particle pellets which comprises the steps of:

(a) coating diamond particles with a carbide-forming metal;

(b) forming a bed of said coated abrasive particles of step (a) with fluidizing gas:

(c) spraying onto the bed of gas-fluidized coated abrasive particles of step (b) a slurry of metallic powder, a binding agent, and a volatile solvent, for a time until each coated abrasive particle of step (a) is outer coated with at least about 20 wt-% of said metallic powder to form metal powder-coated abrasive pellets, said metallic powder having a sintering temperature that is at least about 50° C. lower than the melting point temperature of said carbide-forming metal;

(d) recovering said metal powder-coated abrasive pellets of step (c) substantially devoid of said volatile solvent;

(e) heating said recovered coated abrasive pellets under conditions to form a sintered continuous outer metal coating on said abrasive pellet; and (f) heating said pellets of step (e) at a second higher temperature to liquefy said carbide-forming metal for forming some metal carbide from said diamond particle.

2. The method of claim 1 wherein step (b) comprises spraying onto the bed of gas-fluidized abrasive particles a slurry of carbide-forming metallic powder, a binding agent, and a volatile solvent, for a time until each abrasive particle is coated with at least about 20 wt-% of said carbide-forming metallic powder.

3. The method of claim 1 wherein said carbide-forming metal is selected from nickel, cobalt, iron, chromium, titanium, tantalum, tungsten, molybdenum, boron, vanadium, silicon, zirconium, hafnium, niobium, and alloys and mixtures thereof.

4. The method of claim 1 wherein said temperature differential in step (c) is at least about 100° C.

5. The method of claim 1 wherein said metallic powder of step (c) is selected from cobalt, nickel, iron, copper, tin, molybdenum, boron, titanium, tungsten, chromium, vanadium, manganese, niobium, zirconium, hafnium, and alloys, carbides, and mixtures thereof.

6. The method of claim 2 wherein said carbide-forming metal coated diamond particles are heated to a temperature sufficient to volatilize said binding agent thereform prior to conducting step (c).

7. A handleable, strong, discrete, essentially-spherical, sintered, metal-clad diamond particle pellet which pellet comprises a diamond abrasive particle coated with a metal carbide/carbide-forming metal inner coating and an outer continuous sintered metal coating, the sintering temperature of the metal of said outer metal coating being at least about 50° C. lower than the melting point of said carbide-forming metal of said inner coating, said pellet ranging in size from about 0.2 to 2.4 mm.

8. The pellet of claim 7 wherein said carbide-forming metal is selected from nickel, cobalt, iron, chromium, titanium, tantalum, tungsten, molybdenum, boron, vanadium, silicon, zirconium, hafnium, niobium, and alloys and mixtures thereof.

9. The pellet of claim 7 wherein said metal of said outer metal coating is selected from cobalt, nickel, iron, copper, tin, molybdenum, boron, titanium, tungsten, chromium, vanadium, manganese, niobium, zirconium, hafnium, and alloys, carbides, and mixtures thereof.

10. The pellet of claim 7 wherein said temperature differential is at least about 100° C.

11. A method for making an abrasive particle-containing metal saw blade segment comprising the steps of:

(a) placing a plurality of abrasive pellets, each comprising an abrasive particle coated with at least about 20 wt-% sintered metal, metal particles devoid of abrasive particles, and a source of braze metal in a mold cavity; and (b) heating the contents of said mold cavity under conditions of temperature, pressure, and atmosphere to form an abrasive particle-containing metal saw blade segment of desired abrasive particle concentration.

12. The method of claim 11 wherein said abrasive particles are selected from diamond particles and cubic boron nitride (CBN) particles.

13. The method of claim 11 wherein said metal coating is selected from cobalt, nickel, iron, copper, tin, molybdenum, boron, titanium, tungsten, chromium, vanadium, magnanese, niobium, zirconium, hafnium, and alloys, carbides, and mixtures thereof.

14. The method of claim 11 wherein said segment contains porosity which ranges from about 10% to 50% of full density.

15. The method of claim 11 wherein said coated abrasive particles contain an overcoat of braze metal.

* * * * *